United States Patent [19]

Dyer et al.

[11] Patent Number: 4,653,760

[45] Date of Patent: Mar. 31, 1987

[54] PHOTOSENSITIVE CARTRIDGE FOR WEAPONS ZEROING AND MARKSMANSHIP TRAINING

[75] Inventors: Frederick N. Dyer, Columbus, Ga.; John R. Schjelderup, Springfield, Va.

[73] Assignee: The United States of America as represented by the Secretary of the Army, Washington, D.C.

[21] Appl. No.: 730,125

[22] Filed: May 3, 1985

[51] Int. Cl.[4] ..... F41G 3/26

[52] U.S. Cl. ..... 273/310; 434/22

[58] Field of Search ..... 273/310, 311, 312; 434/22

[56] References Cited

U.S. PATENT DOCUMENTS

| | | | |
|---|---|---|---|
| 2,082,218 | 6/1937 | Radtke et al. . | |
| 2,188,263 | 1/1936 | Eisenberg . | |
| 2,294,558 | 6/1940 | Hooker et al. . | |
| 3,240,924 | 3/1966 | Darby . | |
| 3,271,032 | 9/1966 | Rabinowitz et al. . | |
| 3,526,972 | 9/1970 | Sumpf . | |
| 3,573,868 | 4/1971 | Giannetti . | |
| 3,918,714 | 11/1975 | Ceccaroni . | |
| 3,945,133 | 3/1976 | Mohon et al. | 434/22 |
| 4,054,290 | 10/1977 | Villa . | |
| 4,065,860 | 1/1978 | Linton et al. . | |
| 4,102,059 | 7/1978 | Kimble et al. | 273/311 X |
| 4,195,422 | 4/1980 | Budmiger . | |
| 4,234,911 | 11/1980 | Faith | 273/310 X |
| 4,266,776 | 5/1981 | Goldfarb | 273/310 |
| 4,367,516 | 1/1983 | Jacob | 273/310 X |

*Primary Examiner*—Anton O. Oechsle

*Attorney, Agent, or Firm*—John H. Raubitschek; Francis A. Cooch; Werten F. W. Bellamy

[57] ABSTRACT

The invention provides a light sensitive dummy cartridge for insertion into the chamber of a magazine-type weapon. A muzzle collimator is inserted into the barrel in alignment with the cartridge photosensor and the longitudinal axis of the bore. The power supply, audible scoring apparatus, and electrical circuit for the photosensor, moreover, are mounted in a dummy magazine. This combination provides an easy-to-install apparatus for temporarily converting a conventional firearm into a photoresponsive training device.

3 Claims, 3 Drawing Figures

PHOTOSENSITIVE CARTRIDGE FOR WEAPONS ZEROING AND MARKSMANSHIP TRAINING

BACKGROUND OF THE INVENTION

This invention relates to training devices and, more particularly, to a photosensitive dummy cartridge and magazine for temporarily converting a conventional firearm into a light-responsive training device, and the like.

Marksmanship training devices have been in use almost as long as firearms. The need for training devices of this nature arises from many sources. Thus, in its initial stages, at least, marksmanship training is much more effective if it is conducted in a relatively calm and stress-free atmosphere, away from the obvious tensions of the firing range and the presence of live ammunition. Cost reduction is another important consideration in the application of training devices to firearm proficiency. Illustratively, ammunition, even "training" ammunition, is expensive not only on a unit cost basis, but also from the standpoint of transportation, storage, accountability control and issue.

There is the further problem of the availability of suitable firing ranges. Certainly, for many modern weapons, ranges must be large. In these circumstances, there are first a limited number of possible ranges that can be used for "live firing" training purposes. Range utilization scheduling, the expense and inconvenience of moving troops and equipment to and from these facilities are, to identify just a few reasons, further examples of the very pressing need to develop realistic alternatives to "live firing" exercises.

Aside from the need for introducing genuine economies in military training with arms of all sorts, there also are a number of non-military needs for some apparatus that will assist in establishing and maintaining proficiency with small arms without using "live" or "ball" ammunition. Typically, police forces, sportsmen, competitive marksmen and the like, all may wish to train regularly with weapons in the absence of frequent accessibility to suitable "live firing" range facilities.

There is still a further need for marksmanship apparatus for amusement, or "arcade" application. A visit to any "arcade" will show at a glance that weapons simulators and marksmanship related devices are among the more popular "games". From a troop training viewpoint, moreover, the enthusiasm that many young people have for these "arcade" games can be carried over into a similar level of enthusiasm among young recruits for weapons training, if the exercises are realistic and presented in an "arcade" game format.

Consequently, improvements in apparatus of this nature that will increase realism will certainly enhance user, or player interest and entertainment.

Thus, there is a need for an improved device that can be adapted to a large number of weapons in order to create a more realistic environment for training and entertainment purposes without introducing a need for expensive "live" ammunition and conventional range facilities.

SUMMARY OF THE INVENTION

These and other marksmanship training needs are satisfied, to a great extent, through the practice of the invention.

The invention, typically, has a dummy cartridge for insertion into the chamber of a magazine-type firearm.

The cartridge also has, at a crimped end, a light or photo-sensitive detector which is oriented toward the firearm's muzzle. The detector, too, is in general alignment with the axis of the bore. A collimating tube having a centrally disposed aperture is inserted in the muzzle of the firearm. The collimator insures that light will only enter the bore through the aperture and, hence, produce a beam that is coincident with the bore axis. A dummy magazine is also provided to mount the amplifier, scoring mechanism and power supply for the apparatus.

When the firearm is in correct alignment with a light source, e.g., an ordinary light bulb, at the target, a collimated beam of light from the target within the bore activates the photo-sensitive detector to generate an electrical signal which produces an audible, or other suitable signal, to inform the student that the "sight picture" is correct and that the weapon is properly aimed.

A further embodiment of the invention couples the manipulation of the trigger with the operation of the scoring signal in order to enable the user to practice the complete sequence of coordinated activity in firing small arms. A bypass switch in the electrical circuitry allows continuous operation of the system so that the gunsights can be adjusted to coordinate with target light detection.

Thus, there is provided in accordance with the invention a relatively simple and inexpensive device for marksmanship practice that is suitable for use with any magazine firearm. Not only can the device be used without modifying the firearm, thereby permitting the user to become more familiar with his own weapon, but also the power supply and other electrical circuits in the magazine add to its weight and provide the more realistic "feel" of aiming and firing a weapon with a fully or partially loaded magazine.

The usual inconveniences and expenses, moreover, that are associated with "live firing" exercises are completely avoided through the practice of the invention.

For a more complete appreciation of the invention, attention is invited to the following detailed description of preferred embodiments of the invention taken in conjunction with the drawing. The scope of the invention, however, is limited only through the claims appended hereto.

DETAILED DESCRIPTION OF THE PREFERRED EMBODIMENTS

Figure 1:
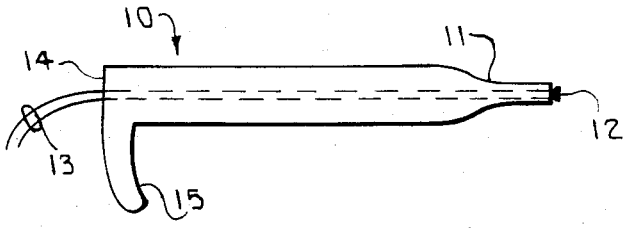
FIG. 1 is a side view of a dummy cartridge suitable for use in connection with the invention.

For a more detailed understanding of the invention, attention is invited to FIG. 1, which shows a dummy cartridge case 10. The end of the cartridge case 10 that usually mounts the projectile, in accordance with a feature of the invention, is crimped 11 to securely hold a photo-sensitive, or light sensitive detector 12. For the purpose of the invention, a Motorola MRD 3056 transistor is satisfactory for use as the detector. The detector 12 is electrically coupled to a pair of conductors 13 that extend through the length of the cartridge case 10 to protrude from base 14 of the case. As illustrated in the drawing, the base 14, instead of being shaped in the usual circular configuration, has a small finger grip 15 that protrudes in a radial direction from the base 14 to facilitate manual insertion and extraction of the case 10 from the chamber of a firearm (not shown in the drawing).

Figure 2:
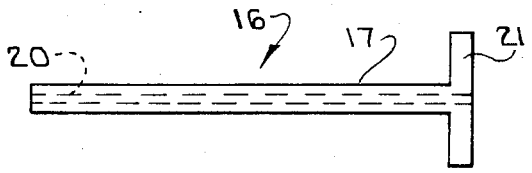
FIG. 2 is a side view of a collimator tube for use with the dummy cartridge shown in FIG. 1.

A collimator tube 16 is shown in FIG. 2. As illustrated, the tube 16 has a generally cylindrical shape, with a shank 17 that fits snugly within the muzzle end of a firearm bore (not shown in the drawing). A centrally disposed aperture 20 within the tube 16 collimates a beam of light, in accordance with a salient feature of the invention. To aid in insertion and to limit the admission of light into the bore (not shown) to that provided by the aperture 20, a transversely disposed plug, or closure 21 is secured to the extreme muzzle end of the collimating tube 16.

Figure 3:
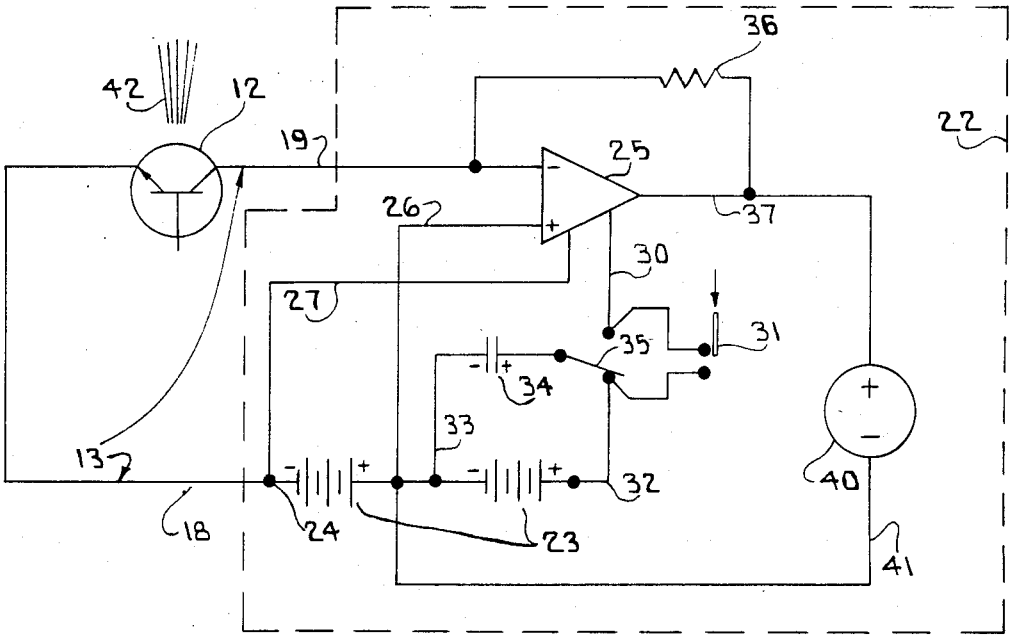
FIG. 3 is a schematic diagram of an electrical circuit, mounted within a magazine and electrically coupled to the cartridge shown in FIG. 1.

Turning now to FIG. 3 a dummy magazine 22, depicted schematically by means of a broken line, encloses a low voltage, e.g. ±3 volts up to ±18 volts, power supply 23. More specifically, four size AAA dry cells are suitable for this purpose. Negative terminal 24 of the power supply 23 is coupled to a conductor 18 in the pair of conductors 13 that are connected to the photo-sensitive detector 12. The conductor 18, moreover, also is coupled to the detector's emitter terminal. The base terminal of the detector 12 is, in this embodiment of the invention, not coupled to the circuit. The collector electrode of the detector 12, however, is connected through conductor 19 in the pair of conductors 13 to the negative signal input terminal of an amplifier 25, the positive signal input terminal of the amplifier being connected to ground, or the zero voltage terminal of the power supply 23 through a conductor 26. For the purpose of the invention, a type 741 amplifier is satisfactory for use as the amplifier.

Negative voltage is supplied to the amplifier 25 from terminal 24 through a conductor 27. The amplifier 25 is also connected to the positive terminal of the power supply 23 through a path that includes a conductor 30, enabled contacts of switch 31 and another conductor 32. Alternatively, a short burst of positive voltage is coupled to the amplifier 25 from the ground, or zero voltage terminal of the power supply 23 through a path that includes a conductor 33, a capacitor 34 and a single pole, double throw trigger operated microswitch 35 that is enabled to couple the capacitor 34 to the conductor 30.

The output terminal of the amplifier 25 is connected to the input conductor 19 through a feedback resistor 36, having a value of, e.g., 8.2 Megohms, by way of a conductor 37. An audible signaling device 40, of which either a Sonalert model SC 628 or an Erie model PKB5-3AO is suitable for the purpose of the invention also is connected to the output terminal of the amplifier 25 through the conductor 37 and to the ground, or the zero voltage terminal of the power supply 23 through a conductor 41.

In operation, the collimator tube 16 is inserted into the muzzle of the firearm in a manner that permits the shank 17 to protrude snugly into the bore and the closure 21 to press against the transverse surface of the muzzle in a generally light-tight fashion. The dummy cartridge case 10 is pressed into the chamber by bearing on the finger grip 15 to avoid stressing the conductors 13. Within the chamber, the photo-detector 12 in the crimped end 11 of the dummy cartridge 10 is oriented toward the aperture 20 in the collimator tube 16. The dummy magazine 22 is inserted in the firearm (not shown), and the firearm is aimed at a light-emitting target (also not shown).

Consider now FIG. 3, in which a quantum of light 42, admitted to the bore through the collimator aperture 20, activates the photo-detector 12. The signal from the activated transistor 12 is applied to the amplifier through the conductor 19 to generate a signal in the output conductor 37, if, in the configuration shown in FIG. 3, the switch 31 is operated to complete the circuit from the positive terminal of the power supply 23 through the conductors 32 and 30 to the amplifier 25. In this specific switch setting, the signaling device 40 will emit a continuous sound as long as light quanta 42 continue to activate the photo-detector 12, that is, as long as the firearm remains in correct alignment with the light emitting target. The continuous activation of the signaling device 40 is an especially good training aid to teach the user a proper "sight picture" and to practice holding the firearm steadily on the target, as well as to "zero" the weapon.

For practice in which the manipulation of the trigger in coordination wth the acquisition of a correct sight picture is desired, the switch 31 is disabled to establish an open circuit between the conductors 30 and 32. When the user perceives a correct sight picture, the trigger is operated and, through the resulting movement of the firing pin (also not shown), or the like, the trigger microswitch 35 is enabled to complete a circuit from the capacitor 34 to the amplifier 25 through the microswitch and the conductor 30. This circuit configuration permits the signaling device 40 to sound only as long as a sufficient charge is available from the capacitor 34 to activate the amplifier 25. Consequently, the duration of the scoring signal can be of a predetermined length, depending on the time constant of the circuit and capacitance of the capacitor 34. For example, a capacitance of 100 microfarads gave a signal duration of approximately ¼ second. Upon depletion of the charge on the capacitor 34, the amplifier 25 is de-energized and the signaling device 40 terminates its scoring sound. Should the user fail to align the firearm with the light emitting target, the collimator tube 16 (FIG. 2) will prevent light from entering the bore. In this circumstance, there will be no light quanta to activate the photo-detector 12 (FIG. 3) and the signaling device 40 will not sound in spite of an enabling setting on the trigger microswitch 35.

For the further purpose of the invention, it has been found that a target, illuminated with a 75 watt, incandescent lamp shining through one or more red filters and a ½" diameter target aperture at a distance of 15' from the muzzle of the firearm will produce satisfactory results. Also, a 300 watt, incandescent lamp enabled use of a smaller target aperture at a greater distance. Of course, the invention is not limited to the visible portion of the spectrum, but would be equally as well adapted to, for example, infrared wavelengths, or the like.

The invention, consequently, makes available an easily installed device that temporarily converts a conventional firearm into a realistic training device. The apparatus characterizing the invention, moreover, provides adequate marksmanship training at less cost and physical risk than the usual "live firing" exercises and with greater realism than customary "arcade" marksmanship devices.

We claim:

1. A marksmanship training device for use with a magazine type firearm comprising a collimator tube having a centrally disposed aperture, said collimator being adapted to fit in the muzzle end of the bore in the firearm's barrel, a dummy cartridge case for insertion in the chamber of the barrel, said cartridge having a crimped end for orientation toward the aperture in said collimator tube, a photo-sensitive detector mounted in said crimped cartridge end, also in alignment with said collimator aperture, a dummy magazine for the firearm, an amplifier coupled to said photo-sensitive detector and mounted within said dummy magazine, a signaling device within said dummy magazine and coupled to said amplifier for producing a scoring signal when said photo-sensitive detector is activated by light quanta admitted to the firearm bore through said collimator aperture, and switch means mounted in said dummy magazine for selectively energizing said amplifier to generate said scoring signal.

2. A marksmanship training device according to claim 1, wherein said switch means further comprises a switch to continuously generate a scoring signal in response to light quanta activation of said photo-sensitive detector and a trigger activated microswitch for generating a scoring signal of predetermined duration in response to light quanta activation of said photo-sensitive detector.

3. A marksmanship training device according to claim 2 wherein said trigger activated microswitch further comprises a capacitor for selective coupling to said amplifier in order to activate said amplifier for said predetermined scoring signal duration.

* * * * *